US007786660B2

(12) United States Patent
Aurongzeb

(10) Patent No.: US 7,786,660 B2
(45) Date of Patent: Aug. 31, 2010

(54) HIGHLY EMISSIVE CAVITY FOR DISCHARGE LAMP AND METHOD AND MATERIAL RELATING THERETO

(75) Inventor: Deeder Aurongzeb, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 356 days.

(21) Appl. No.: 11/702,919

(22) Filed: Feb. 6, 2007

(65) Prior Publication Data

US 2008/0185951 A1 Aug. 7, 2008

(51) Int. Cl.

| | |
|---|---|
| ***H01J 19/14*** | (2006.01) |
| ***H01J 63/04*** | (2006.01) |
| ***H01J 17/06*** | (2006.01) |
| ***H01J 61/04*** | (2006.01) |
| *C25D 11/04* | (2006.01) |

(52) U.S. Cl. ..... 313/491; 313/339; 313/618; 313/632; 205/324; 445/50

(58) Field of Classification Search ..... 313/574, 313/618, 339, 631, 632, 605, 491, 575, 576, 313/348, 349, 619, 346 DC, 309, 311, 336, 313/351, 495–497; 205/324–332; 445/46–59
See application file for complete search history.

(56) References Cited

U.S. PATENT DOCUMENTS 3,875,629 A 4/1975 Kerstetter
3,883,764 A 5/1975 Johnson et al.
5,331,249 A * 7/1994 Minamikata et al. ..... 313/632
5,856,726 A 1/1999 Evans et al.
6,784,007 B2 8/2004 Iwasaki et al.
2001/0028872 A1 * 10/2001 Iwasaki et al. ..... 423/447.3

FOREIGN PATENT DOCUMENTS

WO WO 2004079056 A2 * 9/2004

* cited by examiner

*Primary Examiner*—Nimeshkumar D. Patel
*Assistant Examiner*—Steven Horikoshi
(74) *Attorney, Agent, or Firm*—Fay Sharpe LLP

(57) ABSTRACT

The invention relates to an electrode having a nano-hollow array on the surface thereof, the nano-hollow array comprising a plurality of nano-pores or nano-balls, each pore having a diameter of less than 500 nm, formed by a process comprising depositing a uniform metal film on the electrode structure surface at a rate of 2 Å per second or less, annealing the metal film under rapid anneal conditions at a temperature within about 100 degrees of the melting point of the metal film and without subjecting the metal film to a temperature ramp-up to create metal droplets, and anodizing and over-anodizing the metal droplets in the presence of an anodization agent for the metal at from 20 to 200 volts at 0.1 to 2 amps to create nano-pores in the metal droplets or nano-balls to, creating increased surface area and increased electric field around the electrode which enhances speed of fill gas ionization.

5 Claims, 1 Drawing Sheet

FIG. 1
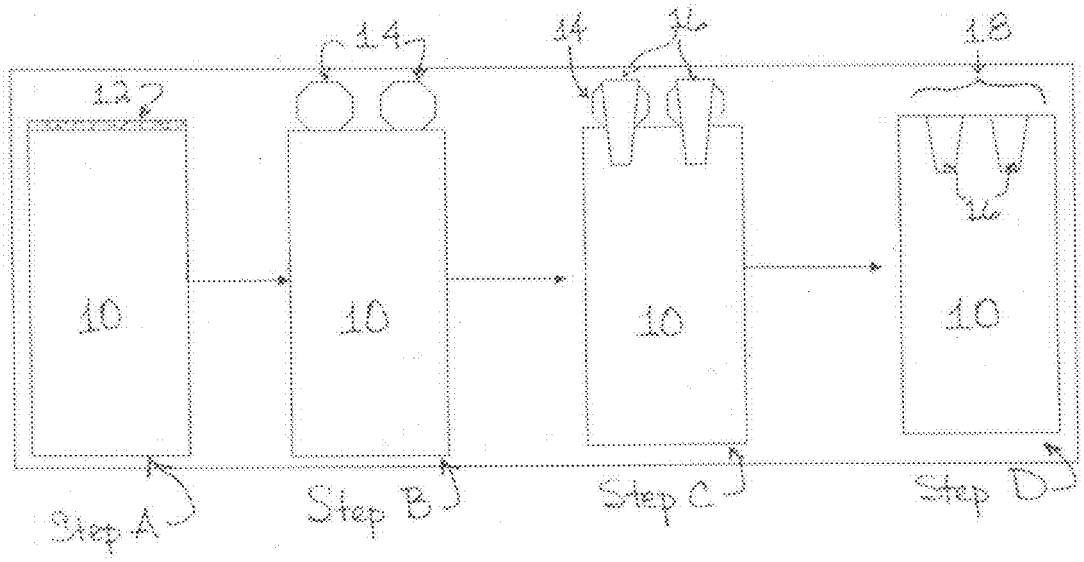
FIG. 2
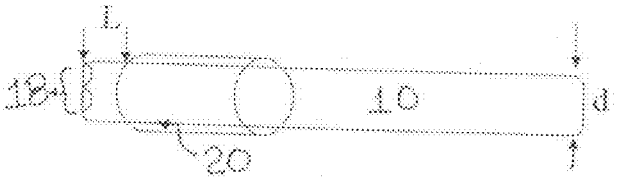
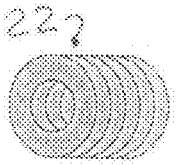
FIG. 3
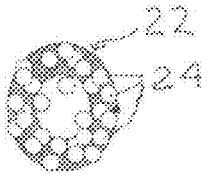
FIG. 4

HIGHLY EMISSIVE CAVITY FOR DISCHARGE LAMP AND METHOD AND MATERIAL RELATING THERETO

BACKGROUND OF THE INVENTION

The present disclosure relates to discharge lamps. It finds particular application with regard to high intensity discharge lamps, incandescent lamps, and high energy photovoltaic devices, and the use therein of thermionic or nonthermionic cavity electrodes or coils or combinations thereof. However, it is to be appreciated that the present disclosure will have wide application throughout the lighting and photovoltaic industry.

During operation, as the cathode material in a discharge lamp experiences current and heat in excess of threshold values, i.e., current in the range of 2 to 5 amps and heat in excess of 3200° C., the cathode suffers erosion. This erosion can result in lamp blackening, which decreases lamp efficiency. It is known that the use of a thermionic hollow cathode can help to reduce cathode erosion due to the presence of cavities which increase the surface area of the cathode. In addition, it has been shown that these hollow cathodes can operate at lower current, thus generating less heat. This results in reduced erosion of the cathode material. Cathode surface cavities have been created by use of an etchant deposition process.

However, the hollow cathodes known according to the above technology continue to require high breakdown voltage to ionize the lamp fill gas. One suggested solution to this problem has been the addition of a third electrode. With regard to the use of tungsten cathode material in discharge lamps, it has further been suggested to use a coil structure to reduce the voltage parameter.

Each of the foregoing, while advancing the technology to some degree, fails to fully address the issue of cathode erosion, and particularly tungsten erosion, in discharge lamps, whether mercury or non-mercury based. The invention disclosed herein is intended to provide a cavity structure, which may be applied to one or both of the electrode and/or a coil used in conjunction with the electrode assembly. The inventive cavity structure provides greatly increased surface area in the form of nano-pores, the presence of which enhances lamp performance. As has been stated, ionization of the fill gas in a conventional discharge lamp, or other lamp, requires the application of high voltage, on the average of 2kv. The presence of the nano-pores creates a high electric field, thus reducing the voltage level needed to breakdown the discharge, or fill, gas. The nano-pores created by the subject inventive processing exhibit pore diameters of from about 50 nm to about 500 nm, thus reducing the voltage requirement and the generation of heat to a point that significantly reduces electrode erosion and consequently enhances lamp performance.

BRIEF DESCRIPTION OF THE INVENTION

The invention relates to an electrode having a nano-hollow array on the surface thereof, the nano-hollow array comprising a plurality of nano-pores or nano-balls, each nano-pore or nano-ball having a diameter of less than 500 nm, formed by a process comprising depositing a uniform metal film on the electrode structure surface at a rate of 2 Å per second or less, annealing the metal film under rapid anneal conditions at a temperature within about 100 degrees of the melting point of the metal film and without subjecting the metal film to a temperature ramp-up to create metal droplets, and anodizing and over-anodizing the metal droplets in the presence of an anodization agent for the metal at from 20 to 200 volts at 0.1 to 2 amps to create nano-pores in the metal droplets or nano-balls, thus creating increased surface area and increased electric field around the electrode to enhance speed of fill gas ionization.

BRIEF DESCRIPTION OF THE DRAWINGS

FIG. 1 is a schematic of the subject process steps.

FIG. 2 shows an electrode with a nano-array on the tip thereof.

FIG. 3 shows a coil for use with an electrode.

FIG. 4 shows a coil having nano-balls formed thereon in keeping with the invention.

DETAILED DESCRIPTION OF THE INVENTION

In those discharge lamps that operate at a current capacity of 4 amps and above, well in excess of the more standard current capacity of 1 to 2 amps used for general lighting purposes, the electrode runs close to the melting point of the electrode material. This results in some melting of the electrode tip. In addition to this phenomenon, at the time of lamp start-up, it is necessary to employ high voltages to ionize the fill gas. While either circumstance alone can cause electrode erosion, the combined effect can be even more detrimental to the electrode, and therefore to lamp life.

The melting point of tungsten, for example, which is a common lamp electrode material, is about 3600° C. In a lamp that runs with high current, such as a compact discharge lamp, the typical electrode tip temperature can be as high as 3500° C., thus causing degradation of the electrode tip, and more than likely eventually causing it to melt.

To combat this problem, the invention disclosed herein involves a process for creating a nano-hollow array on the electrode surface, the increased surface area of which decreases the impact of high voltage operation on the electrode material. FIG. 1 is a schematic setting forth the steps of the process disclosed herein for generating a nano-hollow array. Now, with particular regard to Step A, there is shown an electrode 10. For purposes of this disclosure, the length of the electrode should exceed the diameter of the electrode structure, and preferably should be at least five (5) times the diameter of the electrode structure. Deposited thereon is a film 12 comprising a lower melting point metal, i.e., one having a melting point of less than about 700° C. While the deposited film 12 may be pure low melting point metal, it may also be an alloy thereof, or a combination of two or more such metals or alloys. For example, the film 12 may comprise Al, In, Ga, Sn, and alloys or combinations including these.

In practicing the invention, the electrode structure 10 is coated with a film 12 having a thickness of from about 2 nm to about 20 nm. At thicknesses in excess of about 20 nm the nano-dots that are to be formed from the low melting point metal film 12 will not form. Deposition of the low melting point metal film may be accomplished using any known deposition technique, including but not limited to thermal deposition, electron beam deposition, and sputtering. The deposition is carried out at a rate of about 2 Å per second or less to ensure that the film 12 is uniform. If the film 12 is not deposited in a uniform manner, the resulting surface may be rough, making it difficult to anodize the film in the subsequent processing steps.

The film 12 is then subjected to a rapid annealing process or treatment at a temperature of at least about 300° C., but in all cases at least close to the melting point of the metal comprising the film. In the case of aluminum, which exhibits a melting point of between about 550° C. and 660° C. depending on the thickness of the film, the rapid annealing may be carried out at a temperature of no less than 400° C. and up to about 900° C. By the term "rapid anneal" is meant that the process does not include any temperature ramp-up period. This rapid annealing may be carried out in a any ambient atmosphere, including nitrogen, argon, ammonia or any other suitable atmosphere, or combination thereof, for a period of at least about 10 minutes. Under these processing parameters, only the low melting point metal atoms move fast enough to migrate and coalesce and move upward in random nucleation points to make nanodots. In addition, the surface tension of the low melting point metal enhances the atomic movement.

Without the rapid annealing process, the film 12 may dissolve completely during the following anodizing step. The result of the foregoing rapid annealing process is the conversion of the low melting point metal film 12 into low melting point metal droplets 14, as shown in Step B. These droplets, due to the curvature of their configuration, resist being dissolved during the anodization process, and instead experience the creation of pores 16, as shown in Step C, in the droplets 14, even at lower film thicknesses. Step B shows electrode structure 10 having formed on the surface thereof metal droplets 14. These droplets exhibit a diameter of about 200 nm. The droplet diameter has a linear relationship to the film thickness up to a metal film thickness of about 10 nm. At metal film thicknesses in excess of 10 nm the droplet diameter is dependent on time and temperature and no longer fits the linear relationship. The low melting point metal droplets 14 may be crystalline or non-crystalline in nature, depending on the time and temperature of the rapid annealing process. Droplets exhibiting a crystalline nature are inherently more stable than non-crystalline structures, therefore it is preferable, though not critical, that the rapid annealing process be conducted such that droplets in the crystalline state are generated.

The next step in the process, Step C, involves an initial anodizing step, wherein the droplets 14 are anodized to generate pores 16 therein. The choice of anodizing agent depends on the metal droplet constitution. For example, when the droplets comprise aluminum or a predominantly aluminum alloy, the agent may be a solution of oxalic or sulfuric acid. Depending on the agent and the metal, the anodizing is carried out at from about 20 to 200V at 0.1 to 2 amps. In that instance where the metal droplets are aluminum or contain aluminum, the process may be carried out using 3% oxalic or sulfuric acid at about 50V at 0.1 amps. By optimizing these process parameters, the depth of pore formation and the time necessary to achieve the same can be adjusted. The initial anodizing step creates pores in the droplets having pore diameters of between about 50 nm and 500 nm.

Once the initial anodizing step has been completed, the anodized electrode surface is subjected to further processing to extend the pore structures into the electrode. This further processing may be conducted in any one of several ways. One suitable process is to over-anodize the already anodized surface. The same process parameters are suitable for conducting both the anodizing and the over-anodizing steps, though it is not necessary that the process parameters be the same for both steps. The further process of over-anodizing the droplets 14 extends the pores 16 further into the electrode 10 as set forth in Step D.

As an alternative to the over-anodizing process set forth above, the anodized electrode/droplet combination may be treated with an electrolyte, such as for instance KOH, NaOH, or other suitable electrolyte. This is beneficial, for example, when the electrode material is tungsten. Treatment with either of these electrolytes increases the dissolution rate of tungsten, thus increasing the pore size generated during the process. The pore structure is used to target an electrode area for etching, thus a larger pore can allow etching of a more specific area of the underlying material.

As a further alternative to over-anodizing the already anodized electrode/droplet surface, a plasma etching process may be used to extend the pores 16 further into the electrode surface.

Depending on the process technique selected to extend the pores into the electrode structure, the electrode may require cleaning with an acidic solution to remove remaining low melting point metal film or droplet material. If plasma etching is used, the droplets are completely dissolved during the etching process and generally no further cleaning step is necessary. However, when using an over-anodizing process or an electrolyte to extend the pores structures, the electrode may require cleaning to remove excess droplet material by dissolving. While an acidic solution is well suited for such cleaning, any material that will dissolve the remnants of the droplets may be used.

Regardless of the process selected from the above possibilities, the electrode, once processed will exhibit a nano-hollow array 18 as shown in Step D. The pores generated by the foregoing processing exhibit a particular structure. Specifically, the walls of the pores are stepped and rough, as opposed to being smooth in nature. The stepped, rough walls of the pores increase further the surface area thereof, and consequently also increase the surface area of the electrode.

In addition to the increased surface area, the pore structures generated by the subject process are very small in size. Due to the small pore size, the electric field around the structure increases during operation, which enhances the speed of ionization of the fill gas. Current density is equal to:

$$I/A$$

where I is current and A is the area of the cavity, or pore. High current density, combined with the high electric field provided by the cavity structure achieved herein, provides easy breakdown, or ionization, of the fill gas. In addition, less time at high voltage translates into less electrode degradation and reduced erosion.

The invention will now be discussed with reference to FIGS. 2 through 4. In FIG. 2, electrode 10 is shown having the pore structure, or nano-hollow array 18 created by the foregoing process on the tip thereof. In practice, the nano-hollow array 18 may be located anywhere along the length of the electrode as long as it does not cover more than about 10% of the total electrode length, such that the electrode emits properly and within the high temperature parameter greater than 2700° C. The nano-hollow array, while it is shown here for exemplary purposes only to consist of a few pores, may contain many pores, each having a diameter of from 10 nm to 500 nm. Each cavity represents a highly emissive surface that increases electrode efficiency due to its increased surface area. As has been stated above, the pore walls are stepped and rough in nature, which further increases the surface area thereof and enhances the emissive performance of the overall electrode structure.

As is further seen in FIG. 2, the electrode 10 may be mounted with a tube 20. Alternatively, tube 20 may be replaced by a coil 22 of the type shown in FIG. 3. In either instance, the tube 20 or coil 22 is positioned at a distance L, shown in FIG. 2, from the tip of the electrode. This distance, L, is greater than the electrode diameter, d, also shown in FIG. 2. This placement ensures that the temperature of the tube 20 or coil 22 will be at least 500° C. less than the temperature of the electrode tip. The diameter of tube 20 or coil 22 is greater than d, and the length of the tube 20 or coil 22 is up to one third of the distance, L, to ensure the high temperature of the tube or coil.

The electrode may be tungsten, osmium, molybdenum, rhenium, hafnium, or any other known electrode material. The tube or coil used in combination with an electrode of any of these materials may also comprise any of these materials, or the carbides or nitrides thereof, with the proviso that the electrode material and the tube/coil material not be the same. It is necessary that the materials used represent a lattice mismatch in order for the tube or coil to enhance the electrode performance.

Now with regard to FIG. 4, there is shown coil 22. The coil may be coated with a thin film of osmium, molybdenum, rhenium or hafnium and annealed at a temperature that is greater than half the melting point of the material used to coat the coil to create the metal nano-balls 24. The coating thickness should be between about 3 nm and 7 nm in order to create the nano-balls 24. The coating formed on the coil may be crystalline or polycrystalline, as with the electrode film, depending on the method of deposition used, i.e., electron beam deposition may create a crystalline film while CVD may create a polycrystalline coating. In that instance where the coating formed on the coil is polycrystalline in nature, the initial annealing process should be conducted for at least 60 minutes prior to exposing the coated coil to the rapid thermal annealing process that generates the nano-balls. Depending on the initial coating thickness, the nano-balls may be 50 nm to 400 nm in diameter. The process disclosed herein allows the formation of a single layer or multiple layers of the nano-balls. The metal nano-balls may be formed from one or more of the previously mentioned metals. In that instance where they are formed from an alloy of two or more of these materials, the balls are formed in a single layer due to the high melting point of alloys. When a single material is used as the coating, a double layer of nano-balls may be formed.

In use, it is possible to create metal nano-droplets on the electrode structure in accordance with the foregoing method to generate a nano-hollow array thereon, and to further generate either nano-droplets or metal nano-balls on the tube or coil surface. However, only the coil or tube can be coated with the metal balls.

To increase the stability of the metal nano-balls, the entire coil may be over-coated with high temperature oxides, nitrides, or carbides, for example with MgO, ZrO, HfO, or their nitrides or carbides.

In use, the disclosed invention when used in a lamp assembly provides homogeneous dose distribution by emitting light radially. Additionally, the electrode thus processed is capable of suppressing infrared radiation, and thereby increasing lamp efficiency. As was stated above, the disclosed invention can be easily adapted for use in incandescent or photovoltaic lighting systems to increase the efficiency thereof.

The invention has been described with reference to the preferred embodiments. Obviously, modifications and alterations will occur to others upon reading and understanding the preceding detailed description. It is intended that the invention be construed as including all such modifications and alterations.

What is claimed is:

1. An electrode having a nano-hollow array on the surface thereof, the nano-hollow array comprising a plurality of nano-pores that are randomly formed, each pore having a diameter of from 10 nm to 500 nm, wherein the diameter of each pore narrows as it progresses into the substrate, and each pore having side walls that are stepped and rough in nature, and formed from a metal film deposited on and subsequently removed from the electrode surface during processing to generate the nano-hollow array.

2. The electrode of claim 1 wherein the metal film comprises a metal or an alloy of a metal having a low melting point below about 700° C.

3. The electrode of claim 1 wherein the metal film has a thickness of from about 2 nm to about 50 nm prior to formation of the nano-hollow array and is completely removed from the substrate surface to leave the nano-hollow array in the substrate.

4. The electrode of claim 1 wherein the nano-hollow array does not cover more than about 10% of the electrode surface.

5. The electrode of claim 1 wherein the nano-hollow array is formed by subjecting a low melting point metal film deposited on the electrode surface to rapid annealing, anodizing, and over-anodizing.

* * * * *